US010151495B2

(12) United States Patent
Baumeister et al.

(10) Patent No.: US 10,151,495 B2
(45) Date of Patent: Dec. 11, 2018

(54) HOUSEHOLD APPLIANCE LIGHT

(71) Applicant: BJB GmbH & Co. KG, Arnsberg (DE)

(72) Inventors: Olaf Baumeister, Sundern (DE); Thomas Herbst, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 15/694,779

(22) Filed: Sep. 2, 2017

(65) Prior Publication Data

US 2018/0066850 A1 Mar. 8, 2018

(30) Foreign Application Priority Data

Sep. 2, 2016 (DE) ..... 20 2016 104 855 U
Sep. 23, 2016 (DE) ..... 10 2016 118 041

(51) Int. Cl.

| | |
|---|---|
| ***F24C 15/00*** | (2006.01) |
| ***F24C 7/08*** | (2006.01) |
| ***F21V 33/00*** | (2006.01) |
| ***F21V 13/02*** | (2006.01) |
| ***H05B 6/64*** | (2006.01) |
| ***F21K 9/233*** | (2016.01) |
| ***F21K 9/61*** | (2016.01) |
| *F21W 131/307* | (2006.01) |

(52) U.S. Cl.

CPC ..... *F24C 15/008* (2013.01); *F21K 9/233* (2016.08); *F21K 9/61* (2016.08); *F21V 13/02* (2013.01); *F21V 33/0044* (2013.01); *F24C 7/082* (2013.01); *H05B 6/6444* (2013.01); *F21W 2131/307* (2013.01)

(58) Field of Classification Search

CPC ..... F24C 15/008; F24C 7/082; F21V 5/08; F21V 13/04; G02B 6/0033; G02B 6/005; G02B 6/0055

USPC ..... 362/127

See application file for complete search history.

(56) References Cited

U.S. PATENT DOCUMENTS 5,130,900 A * 7/1992 Makita ..... F21S 41/164 362/517
5,278,731 A * 1/1994 Davenport ..... B60Q 1/0011 362/551

(Continued)

FOREIGN PATENT DOCUMENTS

DE 102009002775 A1 11/2010
DE 102014102355 A1 8/2015

(Continued)

*Primary Examiner* — Bryon T Gyllstrom
(74) *Attorney, Agent, or Firm* — Von Rohrscheidt Patents

(57) ABSTRACT

A household appliance light, in particular a light for cooking devices like ovens, microwaves or steam cookers, the household appliance light including a LED configured as an illuminant; a light housing configured to be arranged at a wall of the household appliance; a light exit opening arranged in the light housing which is enclosed by a light permeable cover; a spacer element which is arranged between the LED and the light exit opening and which is arranged in front of a light outlet plane of the LED; and a reflection device which conducts light emitted by the LED to the cover, wherein the spacer element is a light conductor that is made from one uniform material, wherein the reflection device is a reflector which defines a reflector cavity, and wherein the light conductor is run into the reflector cavity.

11 Claims, 8 Drawing Sheets

(56) References Cited

U.S. PATENT DOCUMENTS

| | | | | |
|---|---|---|---|---|
| 6,350,041 | B1 | 2/2002 | Tarsa et al. | |
| 6,481,130 | B1 | 11/2002 | Wu | |
| 6,991,355 | B1 * | 1/2006 | Coushaine | F21K 9/00 362/555 |
| 8,569,942 | B2 * | 10/2013 | Kishimoto | F21S 41/16 313/483 |
| 8,851,694 | B2 * | 10/2014 | Harada | F21V 9/16 362/84 |
| 8,956,032 | B2 * | 2/2015 | Keuper | G02B 6/0008 362/311.02 |
| 9,068,714 | B2 * | 6/2015 | Takahira | F21V 7/06 |
| 2004/0208019 | A1 * | 10/2004 | Koizumi | B60Q 1/0041 362/545 |
| 2005/0105301 | A1 * | 5/2005 | Takeda | F21S 41/16 362/545 |
| 2005/0152141 | A1 * | 7/2005 | Suzuki | B60Q 1/0052 362/241 |
| 2005/0207177 | A1 | 9/2005 | Guy | |
| 2011/0280039 | A1 * | 11/2011 | Kishimoto | B60Q 1/0011 362/554 |
| 2012/0147624 | A1 | 6/2012 | Li et al. | |
| 2015/0009705 | A1 | 1/2015 | Tsuchiya | |
| 2015/0211710 | A1 * | 7/2015 | Speier | F21S 8/04 362/606 |
| 2016/0047966 | A1 | 2/2016 | Schenkl et al. | |
| 2016/0131818 | A1 | 5/2016 | Sakaguchi et al. | |
| 2017/0003434 | A1 * | 1/2017 | Yang | G02B 6/0045 |

FOREIGN PATENT DOCUMENTS

| | | | |
|---|---|---|---|
| EP | 1598682 | A2 | 11/2005 |
| EP | 2428737 | A1 | 3/2012 |
| EP | 2864694 | B1 | 4/2015 |
| JP | 2011-126262 | A | 6/2011 |
| JP | 2012089256 | A | 5/2012 |
| WO | WO2009141068 | A1 | 11/2009 |
| WO | WO2014120245 | A1 | 8/2014 |

* cited by examiner

HOUSEHOLD APPLIANCE LIGHT

RELATED APPLICATIONS

This application claims priority from and incorporates by reference German Patent Applications
DE 20 2016 104 855.9 filed on Sep. 2, 2016, and
DE 10 2016 118 041.6 filed on Sep. 23, 2016,
both are which are incorporated in their entirety by this reference.

FIELD OF THE INVENTION

The invention relates to a household appliance light, in particular a light for cooking devices like ovens, microwaves or steam cookers, including a LED for an illuminant, a light housing configured to be arranged at a wall of the household appliance, a light exit opening arranged in the light housing which light exit opening is closed by a light permeable cover, a spacer element which is arranged between the LED and the light exit opening and which is arranged in front of the light exit plane of the LED, a reflection device which conducts the light emitted by the LED to the cover.

BACKGROUND OF THE INVENTION

Household appliance lights are well known in the art in many embodiments. The household appliance lights are typically used for illuminating an interior space of a household appliance during operation or for a user to look into the interior space.

No matter whether the household appliances are used for storing food products, for example cooling devices, or household appliances for cooking food products, for example ovens, there are particular requirements which are typically contradictory and hard to meet in their entirety. As matter of principle the illumination of the household appliance interior shall facilitate a sufficient visual perception of the food products by the user which often causes shading problems for example from inserted floors in refrigerators or baking sheets in ovens. Furthermore the illumination shall not blind the user wherein technical components that prevent the blinding cause detrimental light losses.

Using LED's as illuminants has led to new options in the illumination of household appliances. By the same token this technology generates new challenges for engineers.

In particular for cooking devices for food products for example ovens or steam cookers considerable design efforts have to be made in order to prevent an overheating of the LEDs and associated damages. For this purpose not only the heat generated by the LED's have to be removed. Furthermore measures have to be taken in order to minimize temperature loads imparted upon the LEDs by the cooking process.

DE 10 2009 002 775 A1 shall be used as an embodiment for a cooking device light that is known in the art. The light is supported in a known manner in a light housing in a housing cut out. The light exit opening of the light housing is provided with a light permeable cover element which primarily protects the interior space of the light against contamination, but which also already provides a first heat barrier. The light housing includes a cylindrical spacer element at an end that is oriented away from the interior of the cooking device, wherein a cylindrical enveloping surface is enveloped by a reflection material. The circular cover surfaces of the cylinder are provided with light permeable cover elements. The cylinder thus configured is used on the one hand side to offset the LED that is arranged at an end of the cylinder that is oriented away from the cooking cavity as far away from the cooking cavity as possible and to minimize the heat load by this first measure. Additionally the cover elements form additional temperature barriers. The cylinder itself is additionally used as a light shaft in order to run the light emitted by the LED in a direction towards the cooking cavity. Eventually the LED is mounted on a cooling element as an additional measure so that a residual of the operating heat which reaches the LED through the heat barriers can be dissipated.

It is furthermore known from non-patent literature to provide a cavity between the LED and the light exit opening of the inner wall of the cooking space with a light permeable insulation material. Thus, the heat radiation originating from the cooking cavity is minimized and the illumination of the interior space is facilitated.

In the known art the described measures for offsetting the LED from the cooking cavity and for heat shielding reduce the light yield and the illumination quality of the interior of the household appliance. In order to compensate for the reduced light yield more powerful LED's can be used, but their higher operating temperature causes problems.

WO 2009 141 068 A1 or EP 15 98 682 A2 use light conductors in order to conduct the light from a portion that is remote from the cooking cavity into the cooking cavity. The ensuing highly directed radiation, however, requires a plurality of light outlet openings and depending on the technical implementation, a plurality of light sources and light conductors. Additionally the plurality of punctiform sources in the inner housing wall with their high level of brightness is perceived as unpleasant so that these solutions are not very popular due to being expensive and due to a lack of comfort.

Eventually for an optimum illumination of the interior of the household appliance, in particular for cooking devices it is advantageous to arrange plural lights in the housing side walls between the levels provided for the support elements. Thus a light is associated with each of the support elements for ovens, for example with each level that is provided for a baking sheet, so that a shading by additional carrier elements does not impair an illumination quality of the respective level.

Due to the standardized outer dimensions and the goal to keep the usable interior of the cooking device as large as possible the installation spaces provided between the lateral interior walls are rather limited. This makes it difficult to design household appliance lights for cooking devices for using LED's since the distance between the cooking space and the LED that can be used for temperature protection is limited.

Thus, the light losses inherent to the known devices cannot easily be compensated by more powerful LED's in particular when the household appliance light is arranged behind a side wall of a cooking cavity since the more powerful LED's typically generate much more waste heat.

BRIEF SUMMARY OF THE INVENTION

Thus, it is an object of the invention to provide a compact household appliance light in particular for cooking appliances wherein a useable light output of the LED that is effective for interior space illumination is maximized.

The object is achieved by A household appliance light, in particular a light for cooking devices like ovens, microwaves or steam cookers, the household appliance light including a LED configured as an illuminant; a light housing configured to be arranged at a wall of the household appliance; a light exit opening arranged in the light housing which is enclosed by a light permeable cover; a spacer element which is arranged between the LED and the light exit opening and which is arranged in front of a light outlet plane of the LED; and a reflection device which conducts light emitted by the LED to the cover, wherein the spacer element is a light conductor that is made from one uniform material, wherein the reflection device is a reflector which defines a reflector cavity, and wherein the light conductor is run into the reflector cavity.

The essential advantage of the household appliance light according to the invention is that two different light influencing light components are used for maximizing the light yield. The light conductor that is made from one material, for example a light conductor rod made from a synthetic material or glass, thus a light conductor made form a solid material receives the light of the LED, bundles it and conducts it with minimum scatter losses proximal to the light exit opening of the light housing, thus proximal to the inner wall of the household appliance space. Thus, the light conductor is arranged in the reflector space at least in sections so that the scatter radiation exiting from the light conductor is received and also directed towards the light outlet opening of the light housing, thus towards the interior of the household appliance. By the same token the light conductor facilitates a maximum offset of the LED from the household appliance interior and is used for heat shielding. A reflector is also used for heat shielding wherein the reflector does not only reflect the scatter light but also thermal radiation entering from the interior of the housing.

In order to generate a non-blinding illumination of the interior of the household appliance it is provided that a light exit surface of the light conductor is inclined relative to a center axis of the light conductor so that a cone axis of a light cone exiting from the light exit surface is also inclined relative to the center axis of the light conductor, wherein the light outlet surface is oriented away from the user in the application, thus for example inclined towards a rear wall of the cooking cavity. The inclined light outlet surface pivots the exiting light cone into the interior of the household appliance which is embodied by a corresponding inclination of the cone axis which originates from the cone tip and which extends through the center of the cone base. The cone enveloping surface of the exiting light cone is defined by the radiation angle (half value angle of the light exit surface).

It is provided that the light exit surface of the light conductor is inclined relative to the center axis of the light conductor so that the cone axis of the light cone exiting from the light exit surface is also inclined relative to the center axis of the light conductor.

The reflector is essentially used to capture the scatter light which is otherwise lost and does not reach the interior of the household appliance wherein the scatter light inevitably exits from the enveloping surface of the light conductor.

It is furthermore provided that the reflector directs the scatter light mostly in a direction towards the cone axis of the light cone exiting from the light exit surface of the light conductor so that also a blinding of the user caused by the reflective scatter light is mostly prevented.

It is provided that the reflector includes two track shaped reflection surfaces that originate from an apex axis, wherein the apex axis is arranged proximal to a light entry surface of the light conductor. This arrangement proximal to the light entry surface of the light conductor provides that the scatter light exiting from the light conductor is captured by the reflector as a matter of principle.

In particular it is provided that the first track shaped reflection surface is cambered about a camber axis that is parallel to the apex axis wherein it can be provided that the portion proximal to the light entry surface is below a plane in which the boundary beams of the beam cone that is defined by the irradiation angle of the LED impact the boundary surfaces of the light conductor enveloping surface.

This provides that a maximum of the scatter light is captured and reflected in a direction towards the interior of the household appliance.

It is furthermore provided that the light conductor is laterally offset from the apex axis of the reflection surfaces wherein it can be additionally provided that the inclined light outlet surface of the light conductor slopes downward in a direction towards the lateral offset. It is furthermore provided that the second track shaped reflection surface is non-cambered, in particular flat and run proximal to the transition portion of the light outlet surface and light conductor enveloping surface which transition portion is proximal to the light entry surface, wherein the inclination of the second reflector surface relative to the cone axis of the light cone exiting from the light exit surface substantially renders the second reflection surface ineffective.

The offset of the light conductor relative to the apex axis, in particular an offset away from the first reflection surface causes a stronger scatter light yield through the first reflection surface. Due to the inclination of the light exit surface recited supra the direct light exiting from the light exit surface as well as the scatter light reflected back by the reflector is run approximately in the same direction into the interior of the household appliance.

It is furthermore provided that the second track shaped reflection surface is non-cambered and run proximal to the transition portion of light exit surface and light conductor enveloping surface that is proximal to the light entry surface, wherein the inclination of the second reflection surface with respect to the cone axis of the light cone exiting from the light exit surface substantially renders the second reflection surface ineffective.

This way it is assured when the light is installed accordingly that the light is essentially exclusively run towards the household appliance rear wall, in particular the cooking space rear wall of a cooking device.

It is furthermore provided that the reflector and the penetration depth of the light conductor into the reflector cavity are adapted to each other so that the reflector reflects only the scatter radiation exiting from the light conductor but no direct radiation exiting from the light exit surface.

BRIEF DESCRIPTION OF THE DRAWINGS

Further advantages and a better comprehension of the invention can be derived from the subsequent description of an embodiment with reference to drawing figures, wherein.

DETAILED DESCRIPTION OF THE INVENTION

Figure 1:
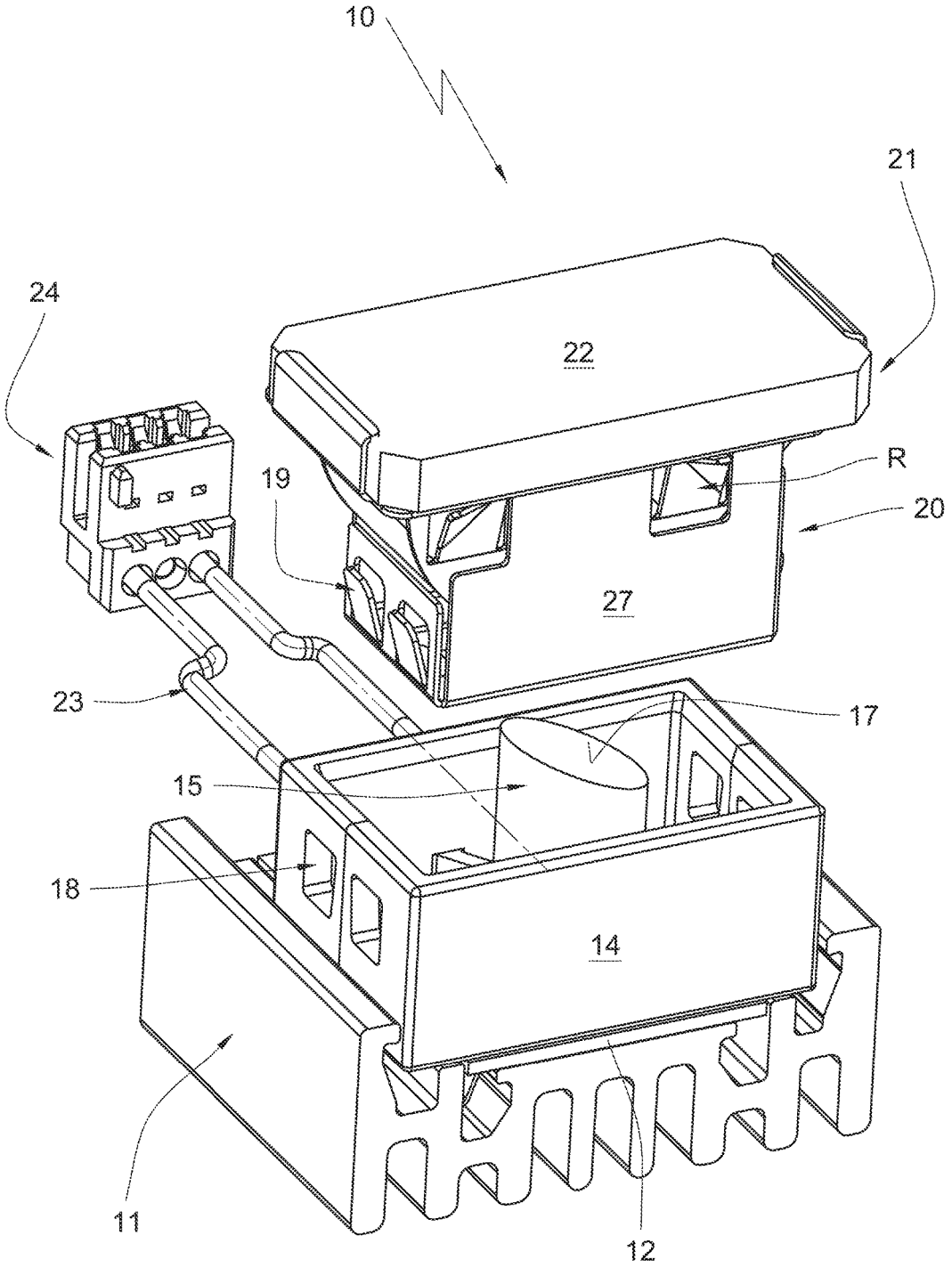
FIG. 1 illustrates an exploded view of a light according to the invention.

In the drawing figures a household appliance light simply referred as a light is designated overall with the reference numeral 10. The household appliance light according to FIG. 1 includes a cooling element 11 on which a circuit board 12 is arranged with an applied LED 13 (FIG. 2)

Additionally a light housing 14 made from an electrically and thermally insulating material like e.g. plastic or ceramic is arranged on the cooling element wherein a light conductor 15 is arranged in the light housing. In the instant embodiment this is a rod shaped light conductor made from glass. The light conductor includes a light entry surface 16 that is arranged proximal to the LED (FIG. 2) and a light exit surface 17 that is arranged remote from the LED. The light exit surface 17 is inclined relative to a center axis of the light conductor 15. With respect to the circuit board 12 the center axis is sloped downward towards the circuit board 12. Furthermore the light exit surface is configured flat.

The light housing 14 includes engagement recesses 18 which facilitate fixing a reflector 20 including an interlocking spring at the light housing 14. The reflector 20 in turn forms a light outlet opening of the light 10 that is not described in more detail wherein the light exit opening is closed by a light permeable cover element 21, a glass pane 22 in the embodiment. Last not least the reflector 20 includes an interlocking element R by which it is fixed in a cut out of a household appliance wall.

In the embodiment the light includes a connection conductors 23 which contact conductor paths of the circuit board 12 with their first ends which is not illustrated and wherein ends of the connection conductors that are oriented away from the circuit board 12 include a plug connector 24 for connecting with a power supply.

Figure 2:
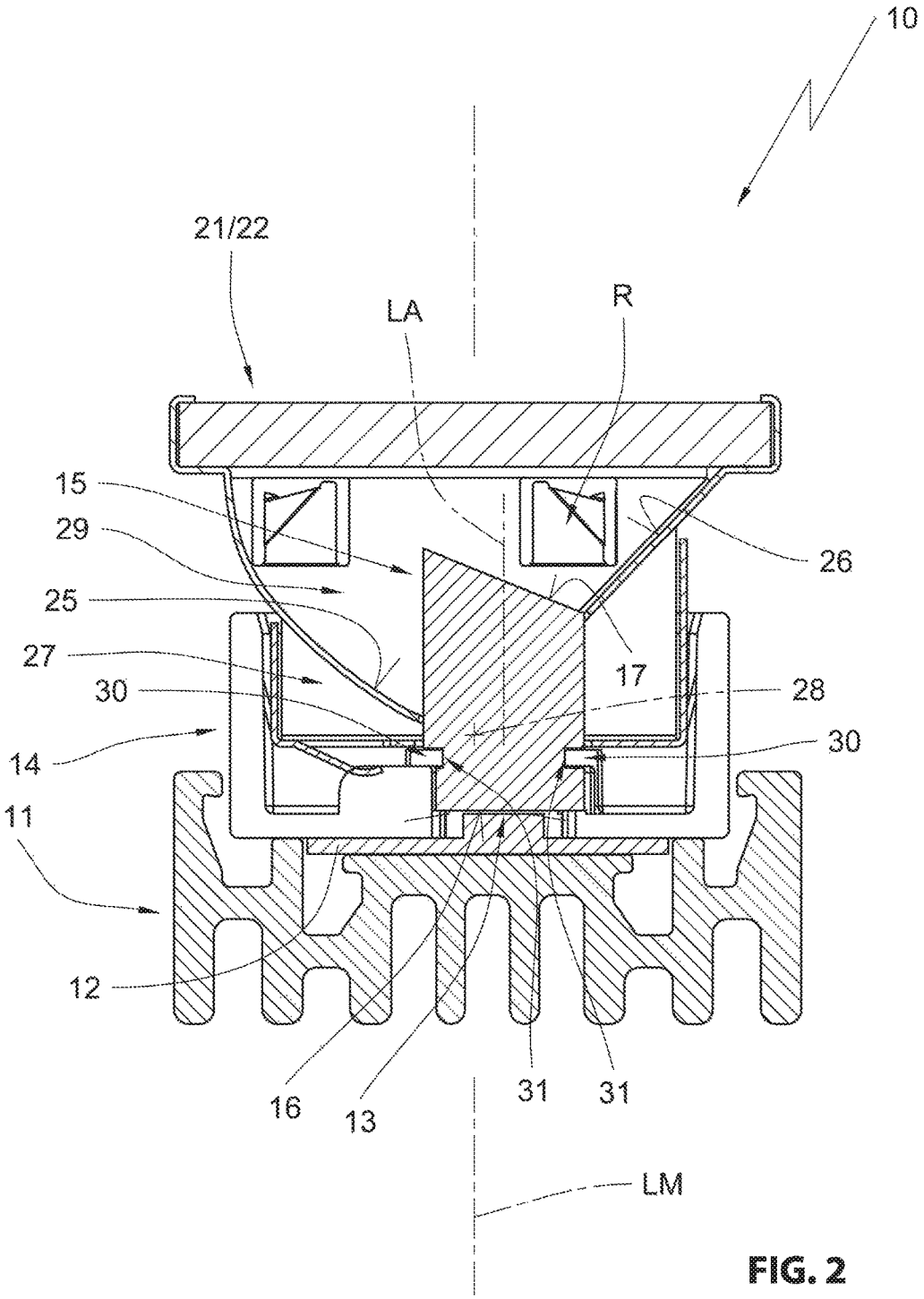
FIG. 2 illustrates a sectional view of the light according to FIG. 1.

FIG. 2 illustrates the light 10 illustrated in FIG. 1 in a sectional view. It can be derived from this sectional view that the reflector 20 forms a first reflection surface 25 and a second reflection surface 26. The reflection surfaces 25/26 form the reflector cavity 29 together with the reflector side walls 27 and start from a common apex axis 28. The reflection surfaces 25, 26 are configured track shaped wherein the first reflection surface 25 is cambered about a camber axis (not illustrated). The camber axis of the first reflection surface 25 is arranged parallel to the apex axis 28. The second reflection surface 26 forms a slanted surface that starts at the apex axis 28. The apex axis 28 is arranged on the light center axis LM which extends through the center of the light housing base surface and through the center of the cover element 21.

The light conductor 15 extends into the reflector cavity 29 and is arranged with its longitudinal axis LA laterally offset from the light center axis LM. The light exit surface is oriented downward towards the circuit board 12 in the offset direction and configured flat. With respect to the reflection surfaces 25 and 26 the light conductor 15 is offset away from the first cambered reflection surface 25 in a direction towards the second reflection surface 26.

Due to this offset and due to the camber of the first reflection surface 25 and due to the configuration of the second reflection surfaces 26 as a slanted surface the first reflection surface 25 impacts the light conductor 15 proximal to the light entry surface. The second reflection surfaces 26, however, intersects the light conductor 25 remote from the light entry surface. Ideally the lowest point of the light exit surface inclined towards the circuit board 12 is arranged in a plane defined by the second reflection surface 26. This special configuration, the asymmetrical reflector 20 with its first cambered reflection surfaces 25 and its second reflection surfaces 26 configured as a slanted surface, the lateral offset of the light conductor 15 from the light center axis LM and the inclined light exit surface 16 causes special radiation characteristics of the household appliance light 10 which are described infra.

Figure 3:
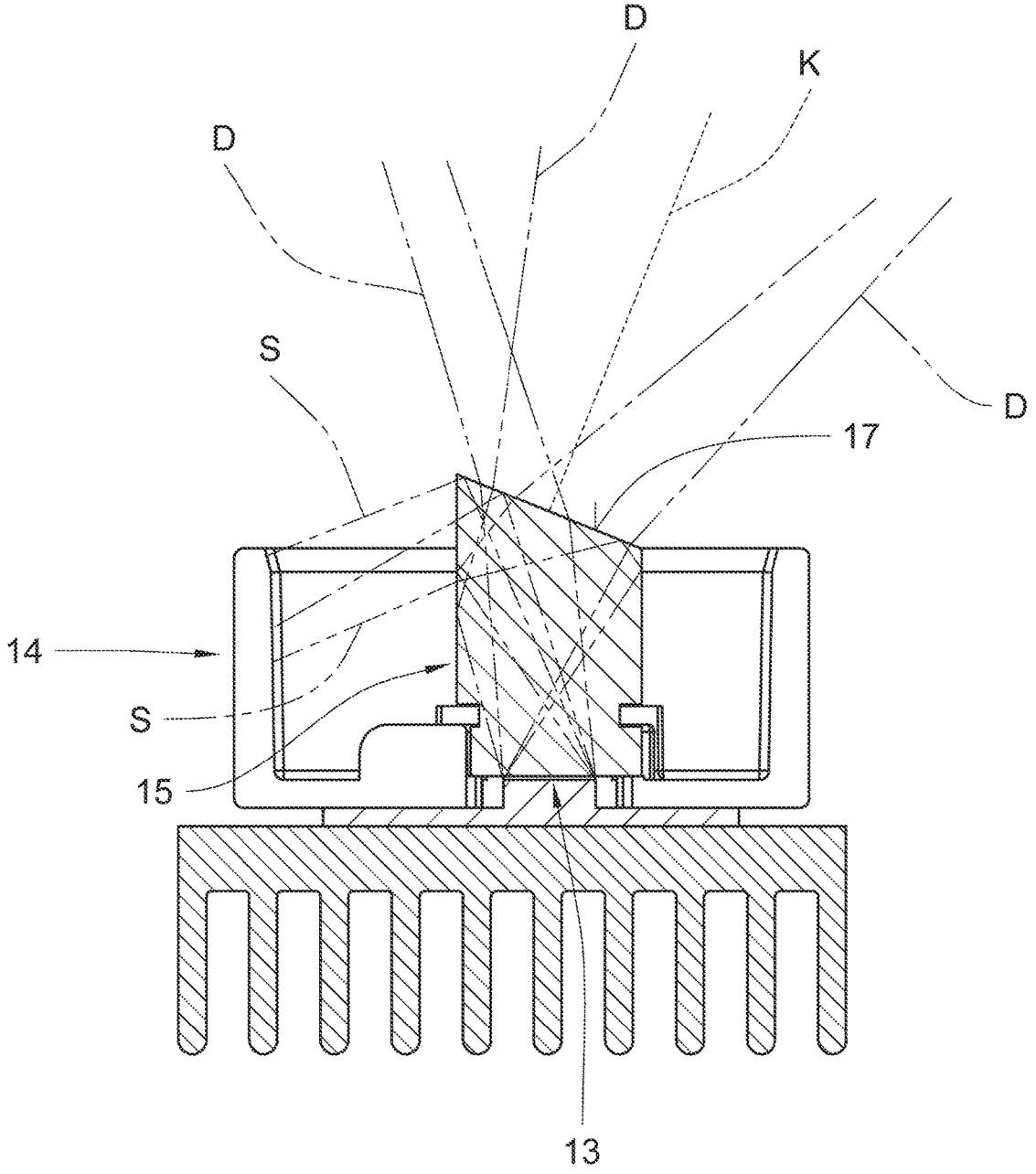
FIG. 3 illustrates a schematic view of radiation characteristics of the light according to FIG. 1 without the reflector according to the invention in a sectional view.

FIG. 3 illustrates a representation similar to FIG. 2 wherein the reflector 20 and the cover glass 22 were omitted in order to illustrate the features that will be described infra. The dashed dotted lines illustrated in FIG. 3 symbolize exemplary light beams which are emitted by the LED 13. Initially light beams are illustrated that are designated by D in FIG. 3 and which exit the light exit surface 17 and are designated as so called direct light. This direct light D exits the light exit surface 17 at a particular radiation angle which forms an opening angle of the light cone exiting the light exit surface 17.

Furthermore exemplary light beams S are illustrated which are reflected at the light exit surface 17 due to their angle of incidence, reflected back into the light conductor 15 and which exit from the enveloping surface of the light conductor 15. The light beams designated with S represent the so called scatter light. FIG. 3 illustrates that the scatter light S is reflected back into the direction of the light housing 14 instead of being reflected in a direction of the non-illustrated glass pane 22 that covers the light exit opening of the light 10. Thus, the light beams S are not available to illuminate the interior of the household appliance and can be designated as lost radiation.

It is also evident from FIG. 3 that the cone axis K of the light cone exiting the light conductor 15 and drawn with dots is tilted in the inclination direction due to the inclination of the light exit surface 17 from vertical. Consequently the light exiting the light conductor 15 is substantially oriented away from the light center axis LM or the light conductor longitudinal axis LA.

Figure 4:
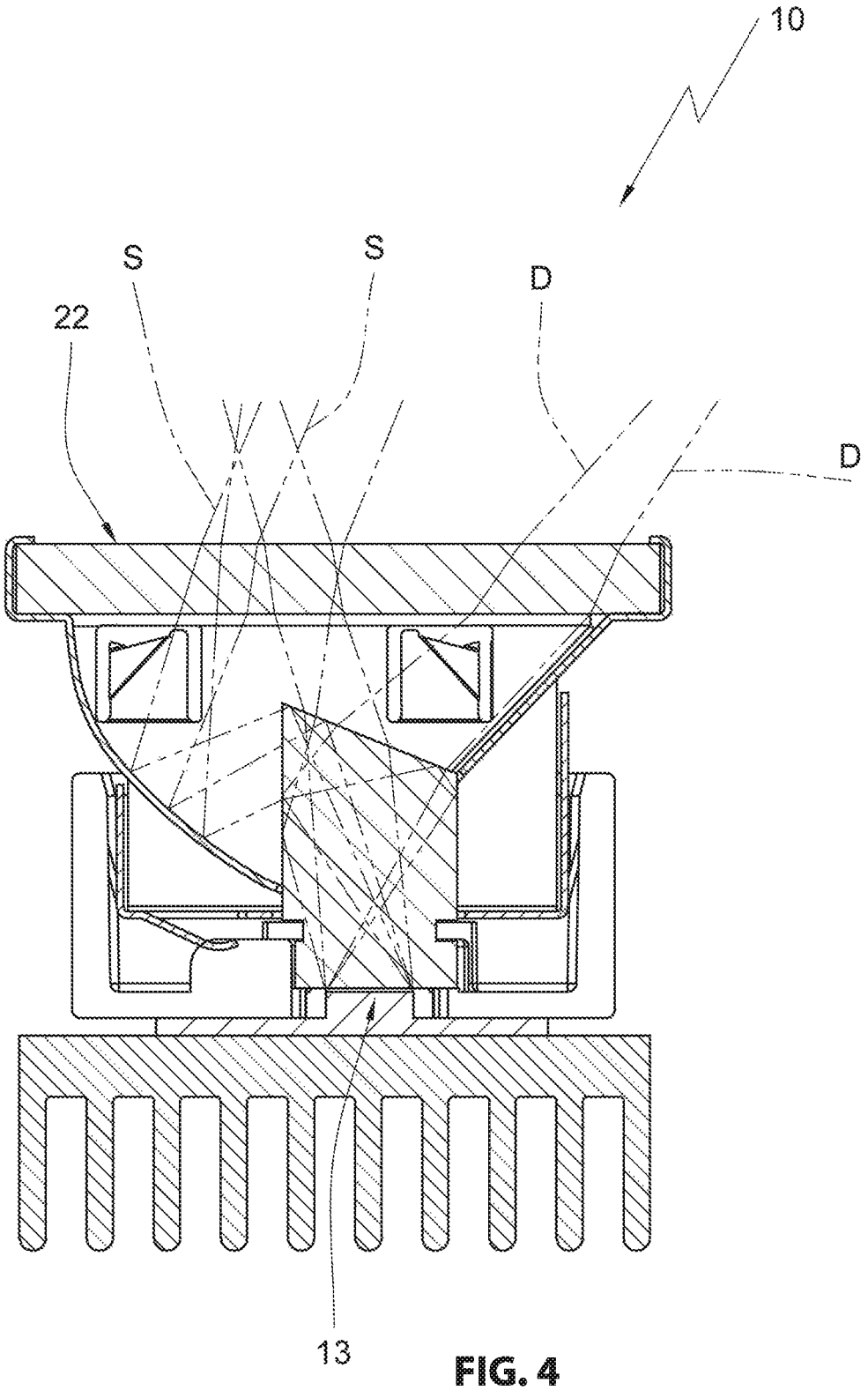
FIG. 4 illustrates a schematic view of radiation characteristics of the light according to FIG. 1 using the reflector according to the invention.

FIG. 4 substantially corresponds to FIG. 2 wherein also here exemplary dashed dotted lines are drawn which represent light beams exiting the LED 13. The effect of the reflector is clearly evident from FIG. 4.

As can be derived from FIG. 4 the scatter beams S are received by the first cambered reflection surface 25 and reflected in a direction towards the cover element 21 and thus in a direction towards the light exit opening of the light 10. The camber of the reflection surface is sized so that it reflects the scatter light in the offset direction of the light conductor 15, thus essentially in a direction towards the cone axis K. Thus, the first reflection surface 25 only absorbs the scatter light for reflection, the direct light D exiting from the light conductor 15 does not impact the first reflection surface 25 due to the arrangement of the light conductor 15 within the reflection space 29.

The second reflection surface 26 is without function due to its location and its inclination towards the light conductor 15 and thus does not reflect any light. This is relevant for the overall radiation characteristics of the light 10 since the second reflection surface 26 in case it performs a reflecting function reflects the light towards the cone axis K.

As evident from FIG. 4 the offset of the light conductor 15 relative to the light center axis LM has the effect that the enveloping surface oriented towards the first reflection surface 25 is maximized and thus the utilization of the scatter light S in view of the desired reflection direction towards the cone axis K is optimized. The light exiting the light exit opening of the household appliance light 10 or the cover element 21 forms a beam bundle which is also tilted overall in an offset direction of the light conductor 15 and thus has an inclination.

When the light according to the invention is installed in a household appliance, in particular a cooking device so that the first reflection surface 25 is oriented away from and opening of the interior space so that the reflection surface orients the scatter light beams S into the interior of the household appliance so that also the cone axis K of the light beam exiting the light exit surface 17 is oriented into the household appliance interior a blinding of a user is effectively prevented.

In order to further optimize the light yield of the household appliance light 10 the attachment arms 30 which engage light conductor grooves 31 and which keep the light conductor 15 in the light housing 14 are arranged in a portion of the light conductor 15 where no light beams impact due to the provided LED radiation emission angle. Thus, it is provided that the light routing of the light conductor 15 is not influenced in a disadvantageous manner.

Figure 5:
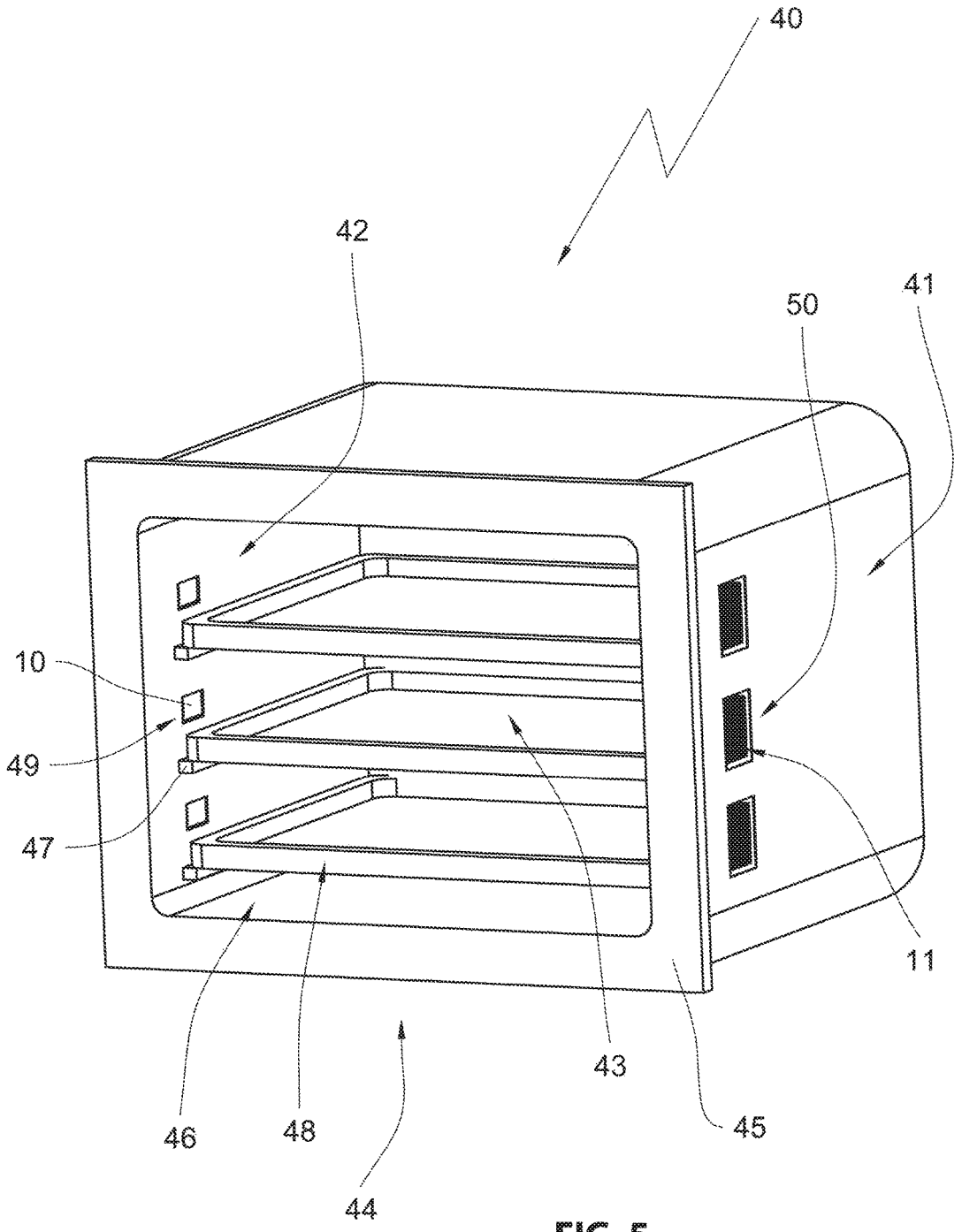
FIG. 5 illustrates an oven with the household appliance light according to the invention in a perspective view.

FIG. 5 illustrates a household appliance configured as an oven 40. The oven includes an outer housing wall 41 and an inner cooking cavity wall 42 which defines a cooking cavity 43. The cooking cavity 43 is accessible through an oven door 44 which is formed from an oven door frame 45 and an oven door glass 46, wherein the oven door glass 46 facilitates a view into the cooking cavity 43. The cooking cavity wall 42 is provided with rails 47 which are arranged at different levels and which support cooking material carriers 48 configured for example as baking sheets. Within cut outs 49 of the cooking cavity wall household appliance lights 10 are mounted whose cooling elements 11 are in contact with outside air for heat dissipation through recesses 50 of the housing wall 41. The oven is illustrated in FIG. 6 in a front view of the oven door 44.

Figure 6:
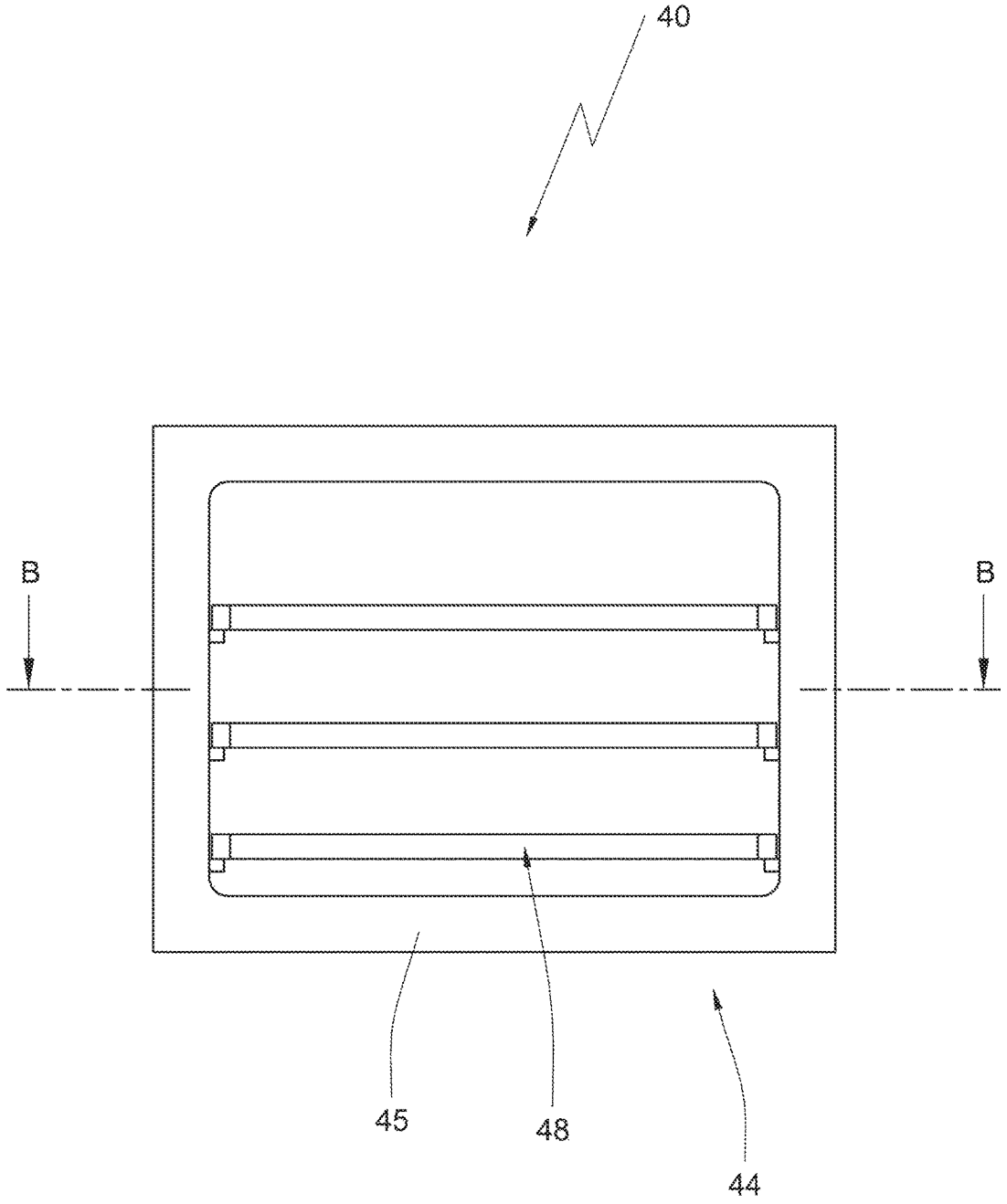
FIG. 6 illustrates the oven according to FIG. 5 in a front view.
Figure 7:
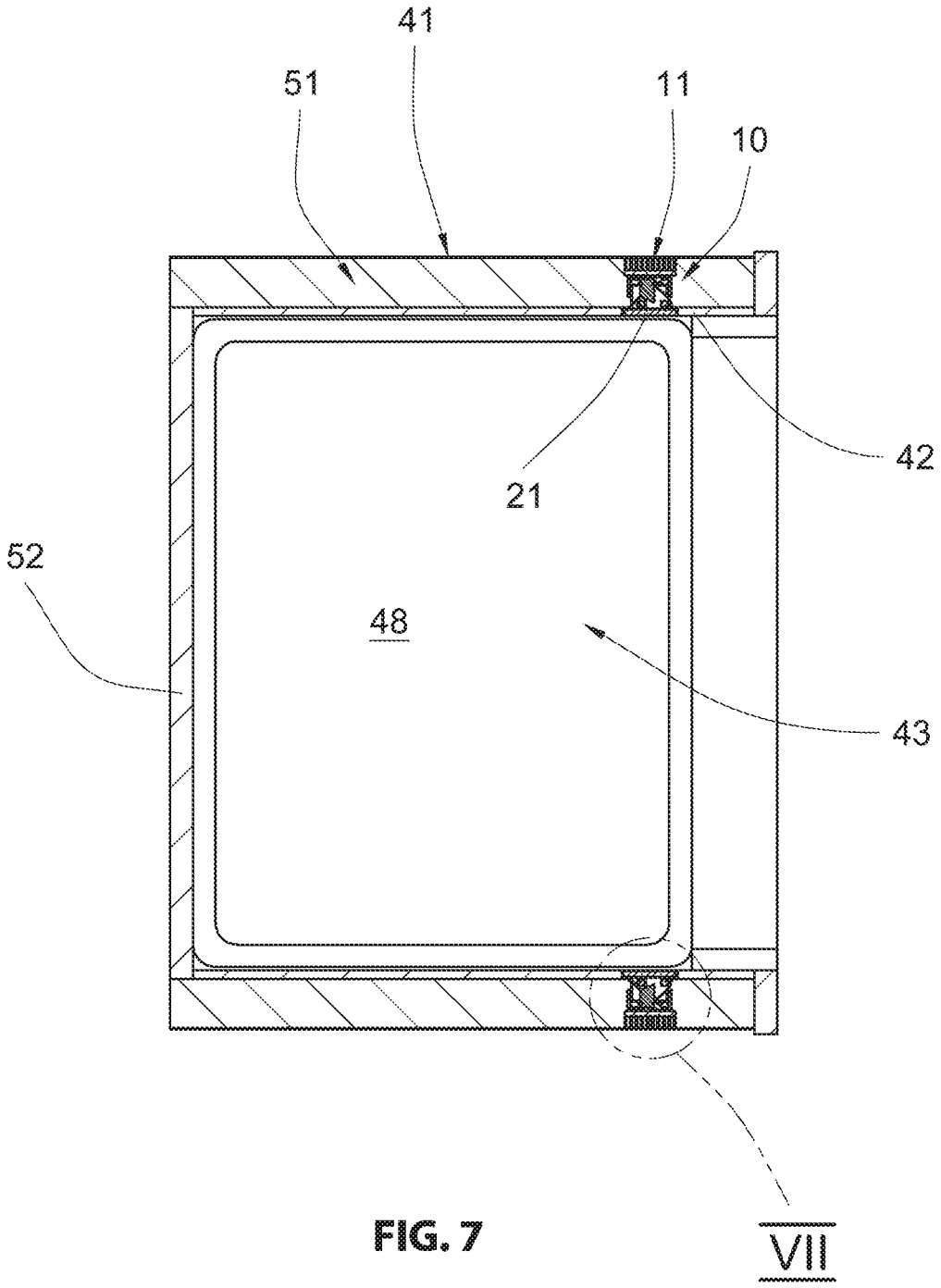
FIG. 7 illustrates a sectional view of the oven according to sectional B-B in FIG. 6.

In FIG. 7 the oven 40 is illustrated in a sectional view along the sectional line B-B in FIG. 6. Thus, the cooking material carrier 48 which is supported on rails 47 is visible in tope view. It is also clearly visible that the side walls are configured with two shelves and an insulation material 51 is arranged between the cooking cavity wall 42 and the housing wall 41. The household appliance light 10 according to the invention is arranged in a recess in the insulation material 51, wherein a cooling element 11 of the house hold appliance light 10 is oriented in a direction towards the housing wall 41 and its cover element 21 is oriented in a direction towards the cooking cavity 43. The rear wall 52 of the cooking cavity which defines the cooking cavity in a rearward direction opposite to the oven door 44 is configured with a single shell in the instant embodiment, a double shell configuration however can also be used.

Figure 8:
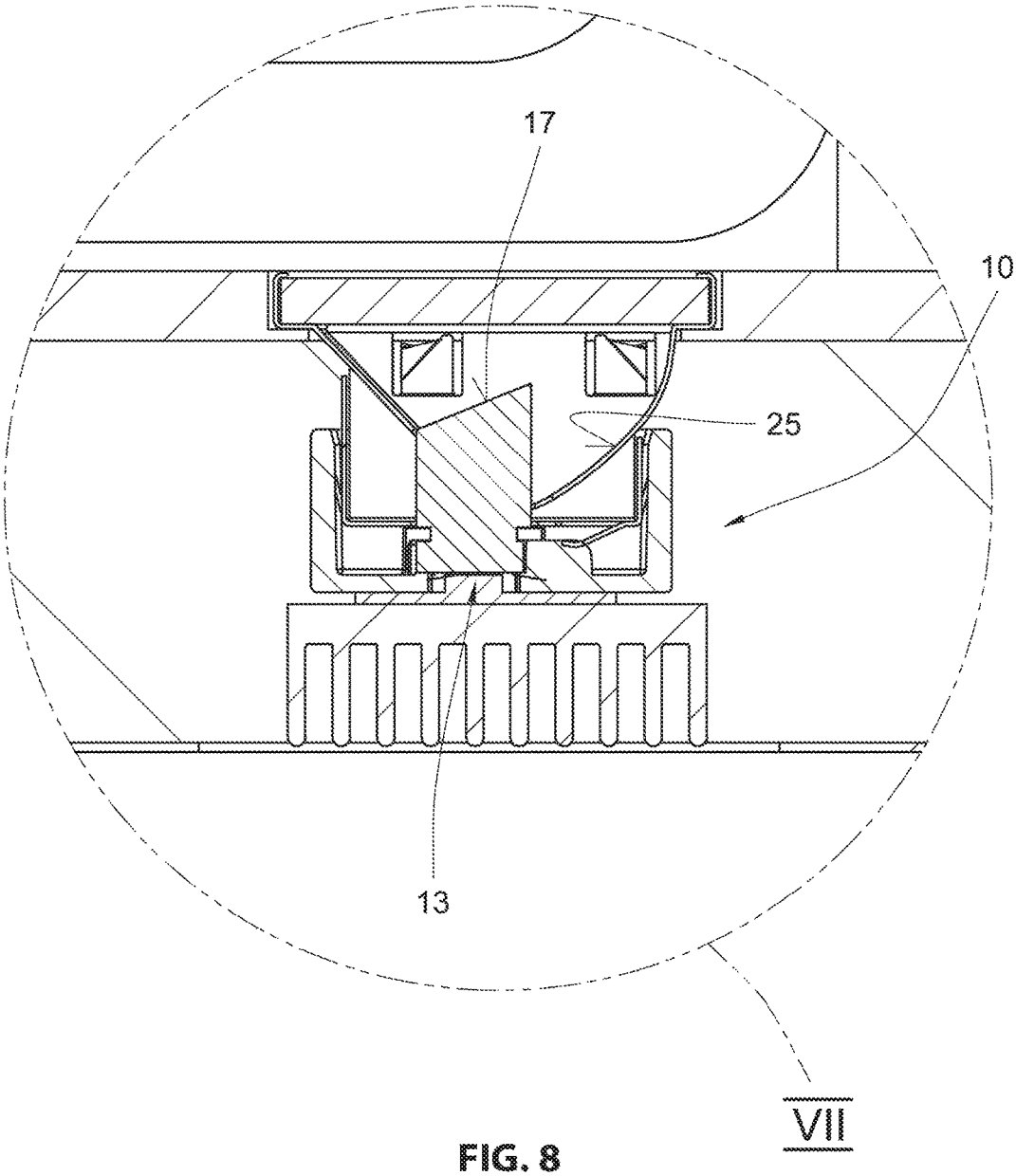
FIG. 8 illustrates a blown up detail according to the detail circle VII in FIG. 7.

FIG. 8 illustrates an enlarged detail according to the detail circle VII in FIG. 7.

This enlarged detail shows details of the light that is arranged in the cooking cavity wall 42. The first reflection surface 25 as well as the light exit surface 17 are oriented in a direction towards the rear wall 52 of the cooking cavity and reflect the light emitted by the LED 13 into the cooking cavity 43 so that the major portion of the emitted radiation is oriented away from the oven door 44. This way using the direct light D as well as the scatter light S and the radiation characteristics of the household appliance light 10 directed towards the rear wall 52 of the cooking cavity prevent a blinding effect for a user watching the cooking process through the oven door glass 46 while using the emitted light in an optimum manner for illuminating the cooking cavity 43.

Overall the invention provides a household appliance light 10 which has special radiation characteristics due to a combination of light conductor 15, a reflector 20 provided with asymmetrical reflection surfaces 25 and 26 and last not least through an offset of the light conductor 15 relative to the light center axis LM which facilitates a non-blinding illumination of an inner cavity of a household appliance. Additionally the light yield is substantially improved by a use of the scatter radiation S of the light conductor 15 which support the desired radiation characteristics. The light conductor 15 facilitates an offset arrangement of the LED 13 from an interior of the household appliance, in particular when the interior is a cooking cavity. The reflector 20 is furthermore not only used for reflecting the scatter light radiation S but also for reflecting the heat radiation exiting from a cooking cavity. This way the household appliance light 10 can be kept compact so that it is also suitable for installation in side walls of household appliances.

REFERENCE NUMERALS AND DESIGNATIONS

10 household appliance light
11 cooling element
12 circuit board
13 LED
14 light housing
15 light conductor
16 light entry surface
17 light exit surface
18 engagement recess
19 engagement spring
20 reflector
21 cover element
22 glass pane
23 connection conductor
24 plug connector
25 first reflection surface
26 second reflection surface
27 reflector side wall
28 apex axis
29 reflector cavity
30 attachment side arm
31 light conductor groove
40 oven
41 outer housing wall
42 cooking cavity wall
43 cooking cavity
44 oven door
45 oven door frame
46 oven door glass
47 rail
48 cooking material carrier
49 cut out
50 recess
51 insulation material
52 cooking cavity rear wall
K cone axis R interlocking element
S scatter light
D direct light
LM light center axis
LA longitudinal axis of 15

What is claimed is:

1. A household cooking appliance light, comprising:
a LED configured as an illuminant;
a light housing that is configured to be arranged at a wall of the household cooking appliance;
a light exit opening that is arranged in the light housing and closed by a light permeable cover;
a spacer element that is arranged between the LED and the light exit opening and that is arranged in front of a light outlet plane of the LED; and
a reflection device that conducts light emitted by the LED to the cover,
wherein the spacer element is a light conductor that is made from one uniform material,
wherein the reflection device is a reflector that defines a reflector cavity,
wherein the light conductor is run into the reflector cavity,
wherein an entire light exit surface of the light conductor is inclined with a uniform inclination relative to a center axis of the light conductor adjacent to the light exit surface so that a cone axis of a light cone exiting from the light exit surface is also inclined relative to the center axis of the light conductor adjacent to the light exit surface,
wherein a scatter radiation exits from a light conductor and the reflector directs the scatter radiation essentially in a direction towards the cover.

2. The household appliance light according to claim 1,
wherein the reflector includes a first track shaped reflection surface and a second track shaped reflection surface that originate from an apex axis, and
wherein the apex axis is arranged proximal to a light entry surface of the light conductor.

3. The household appliance light according to claim 2, wherein the first track shaped reflection surface is cambered about a camber axis that is parallel to the apex axis.

4. The household appliance light according to claim 3, wherein the first track shaped reflection surface is run into a portion of the light conductor that is proximal to the light entry surface.

5. The household appliance light according to claim 2, wherein the light conductor is laterally offset from the apex axis of the first track shaped reflection surface and the second track shaped reflection surface.

6. The household appliance light according to claim 5,
wherein a light exit surface of the light conductor is inclined relative to a center axis of the light conductor so that a cone axis of a light cone exiting from the light exit surface is also inclined relative to the center axis of the light conductor, and
wherein the light exit surface of the light conductor is sloped downward in a direction towards the lateral offset.

7. The household appliance light according to claim 6, wherein
wherein the first track shaped reflection surface is cambered about a camber axis that is parallel to the apex axis,
wherein the second track shaped reflection surface is not cambered and runs to a transition portion of the light exit conductor surface and a light conductor enveloping surface,
wherein the transition portion proximal to the light entry surface, and
wherein an inclination of the second track shaped reflection surface with respect to the cone axis of the light cone exiting from the light exit surface renders the second reflection surface substantially ineffective.

8. The household appliance light according to claim 1, wherein the reflector and a penetration depth of the light conductor into the reflector cavity are adapted to each other so that the reflector reflects only a scatter radiation exiting from the light conductor, but not a direct radiation exiting from the light exit surface.

9. The household appliance light according to claim 1, wherein the center axis of the light conductor is straight and not cambered along an entire length of the light conductor.

10. A household cooking appliance light, comprising:
a LED configured as an illuminant;
light housing that is configured to be arranged at a wall of the household cooking appliance;
a light exit opening that is arranged in the light housing and closed by a light permeable cover;
a spacer element that is arranged between the LED and the light exit opening and that is arranged in front of a light outlet plane of the LED; and
a reflection device that conducts light emitted by the LED to the cover,
wherein the spacer element is a light conductor that is made from one uniform material,
wherein the reflection device is a reflector that defines a reflector cavity,
wherein the light conductor is run into the reflector cavity,
wherein a light exit surface of the light conductor is inclined relative to a center axis of the light conductor so that a cone axis of a light cone exiting from the light exit surface is also inclined relative to the center axis of the light conductor,
wherein a scatter radiation exits from a light conductor and the reflector directs the scatter radiation essentially in a direction towards the cover, and
wherein the reflector directs the scatter radiation substantially in a direction towards a cone axis of a light cone exiting from the light exit surface of the light conductor.

11. A household cooking appliance light, comprising:
a LED configured as an illuminant;
a light housing that is configured to be arranged at a wall of the household cooking appliance;
a light exit opening that is arranged in the light housing and closed by a light permeable cover;
a spacer element that is arranged between the LED and the light exit opening and that is arranged in front of a light outlet plane of the LED; and
a reflection device that conducts light emitted by the LED to the cover,
wherein the spacer element is a light conductor that is made from one uniform material,
wherein the reflection device is a reflector that defines a reflector cavity, and wherein the light conductor is run into the reflector cavity,
wherein the reflector includes a first track shaped reflection surface and a second track shaped reflection surface that originate from an apex axis,
wherein the apex axis is arranged proximal to a light entry surface of the light conductor,
wherein the first track shaped reflection surface is cambered about a camber axis that is parallel to the apex axis, wherein the first track shaped reflection surface is run into a portion of the light conductor that is proximal to the light entry surface, wherein the portion of the light conductor that proximal to the light entry surface is arranged below a plane where boundary beams of a beam cone defined by the radiation angle of the LED intersect boundary surfaces of the light conductor enveloping surface.

* * * * *